US005709054A

United States Patent [19]

McGillivray

[11] Patent Number: 5,709,054

[45] Date of Patent: Jan. 20, 1998

[54] HIGH WIND WINDOW BRACE

[76] Inventor: Harold J. McGillivray, 1108 Gulf Blvd., Ste. 202, Indian Rocks Beach, Fla. 33783

[21] Appl. No.: 785,652

[22] Filed: Jan. 17, 1997

Related U.S. Application Data

[63] Continuation-in-part of Ser. No. 529,457, Sep. 18, 1995, abandoned.

[51] Int. Cl.[6] ..... E04H 9/14; E06B 5/12

[52] U.S. Cl. ..... 52/167.1; 248/200.1; 52/741.3; 52/DIG. 12

[58] Field of Search ..... 52/1, 167.2, 127.2, 52/DIG. 12, 741.3, 506.01; 248/351, 200.1

[56] References Cited

U.S. PATENT DOCUMENTS 2,794,217 6/1957 Croft .
5,339,927 8/1994 Truax .
5,457,922 10/1995 Fara .
5,620,038 4/1997 DeCola et al. ..... 52/DIG. 12 X

*Primary Examiner*—Robert Canfield
*Attorney, Agent, or Firm*—James E. Larson; Larson & Larson, P.A.

[57] ABSTRACT

A window brace includes a vertically disposed pole to which is coupled one or more braces, each of which includes a pad bearing against a portion of a surface of unsupported glass. Each pad defines an internal chamber connected to ambient atmosphere by a check valve such that when the glass bows inwardly toward the pad, air is forced out of the chamber via the check valve that prevents air from returning into the chamber. Evacuation of the chamber, in this way, enhances adherence of the pad to the window glass and, thus, enhances effectiveness of the inventive device. For large pieces of window glass, a plurality of pads may suitably be employed. Alternatively, a valved port in the pad may be connected to a source of vacuum to evacuate the chamber.

20 Claims, 6 Drawing Sheets

HIGH WIND WINDOW BRACE

PRIOR APPLICATION

This application is a Continuation-in-Part of application Ser. No. 08/529,457, filed Sep. 18, 1995 (now abandoned).

BACKGROUND OF THE INVENTION

The present invention relates to a high wind window brace. High wind breakage of windows causes a substantial monetary loss each year worldwide. A window brace can substantially reduce this loss. In the prior art, window braces are known. Applicant is aware of U.S. Pat. No. 2,794,217 to Croft. Croft discloses a window brace including a vertical pole to which a pad is coupled. The pad is engaged against a piece of window glass and clamped thereagainst to brace the window glass against bowing. The present invention differs from the teachings of Croft as contemplating a brace including a pad having an internal chamber with one wall defined by the window glass and wherein air may be evacuated from the chamber when the window glass bows via a check valve incorporated into the pad or may be evacuated from the chamber via a valve connected to a source of vacuum.

SUMMARY OF THE INVENTION

The present invention relates to a high wind window brace. The present invention includes the following interrelated objects, aspects and features:

(1) In a first aspect, the inventive window brace contemplates a vertically disposed pole mountable between floor and ceiling-mounted fixtures. The pole may have a fixed lower pin designed to be received within an opening in the lower fixture and a vertically adjustable upper pin spring-biased in a direction of extension and holdable in a retracted position through the use of a bayonet slot in the pole and a locking lever coupled to the pin and engageable within the bayonet slot to lock the upper pin in a retracted configuration. When the locking lever is moved out of locking position, a spring moves the upper pin upwardly into the opening in the upper fixture to lock the pole in mounted position.

(2) One or more pads are coupled to the post and engaged against a window pane. Each pad includes a generally rectangular shape having a peripheral wall engageable on a window pane and a rear wall defining with the window pane and the peripheral wall an internal chamber. The pad has coupled thereto a threaded stem having a proximal handle, which stem threadably extends through a block engaging a surface of the post facing the pad. Thus, when the stem is rotated with respect to the block, the block engages the surface of the post and causes the stem to reciprocate the pad toward and then against the window pane in clamped fixation.

(3) As the window pane flexes toward the pad responsive to pressure imposed by high winds, the window tends to bow toward the pad in a generally arcuate configuration causing reduction in the volume of the chamber. The rear wall of the brace has a check valve mounted thereon exposed to atmosphere on the downstream side thereof and to the chamber on the upstream side thereof. Thus, as the window bows inwardly, the pad is forced more firmly against the window pane and a consequent reduction in the size of the chamber causes air therewithin to be expelled through the check valve which prevents replenishment of air into the chamber. Thus, a partial vacuum is created within the chamber that provides a suction force tending to maintain adherence of the pad to the window pane. Thus, as winds diminish in strength, the vacuum within the chamber acts to limit flexing of the window pane away from the pad thereby stabilizing the window pane.

(4) If desired, the rear wall of the pad may be provided with a port connected to the chamber on one side and to atmosphere on another side via a manually actuable valve. The port may be connected to a source of vacuum and, once the source of vacuum is activated, the valve may be opened thereby causing evacuation of the chamber. Use of the source of vacuum, the valve and port, allows evacuation of the chamber without the need for waiting for bowing of the window pane to create a partial vacuum within the chamber. Additionally, use of the source of vacuum, valve and port, allows creation of a greater degree of vacuum within the chamber than would be possible through the bowing actions of the window pane.

Accordingly, it is a first object of the present invention to provide a high wind window brace.

It is a further object of the present invention to provide such a device wherein a window brace includes a pad defining, with a window pane to which it is engaged, an internal chamber.

It is a still further object of the present invention to provide such a device wherein the internal chamber may be partially evacuated either through bowing actions of the engaging window pane or through evacuation of the chamber via a port and valve.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
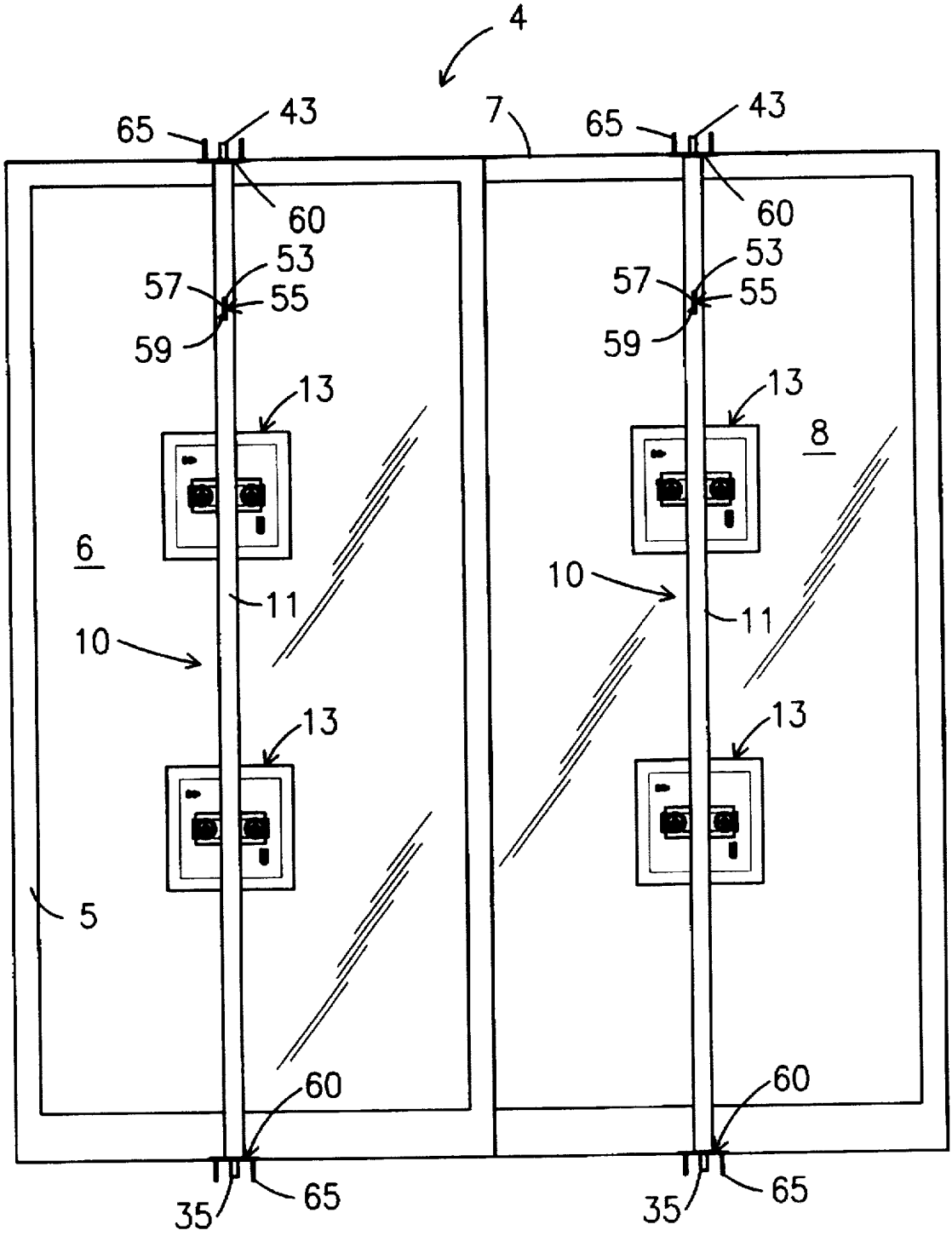
FIG. 1 shows a front elevational view of the present invention as applied to a double window sliding glass door system.
Figure 2:
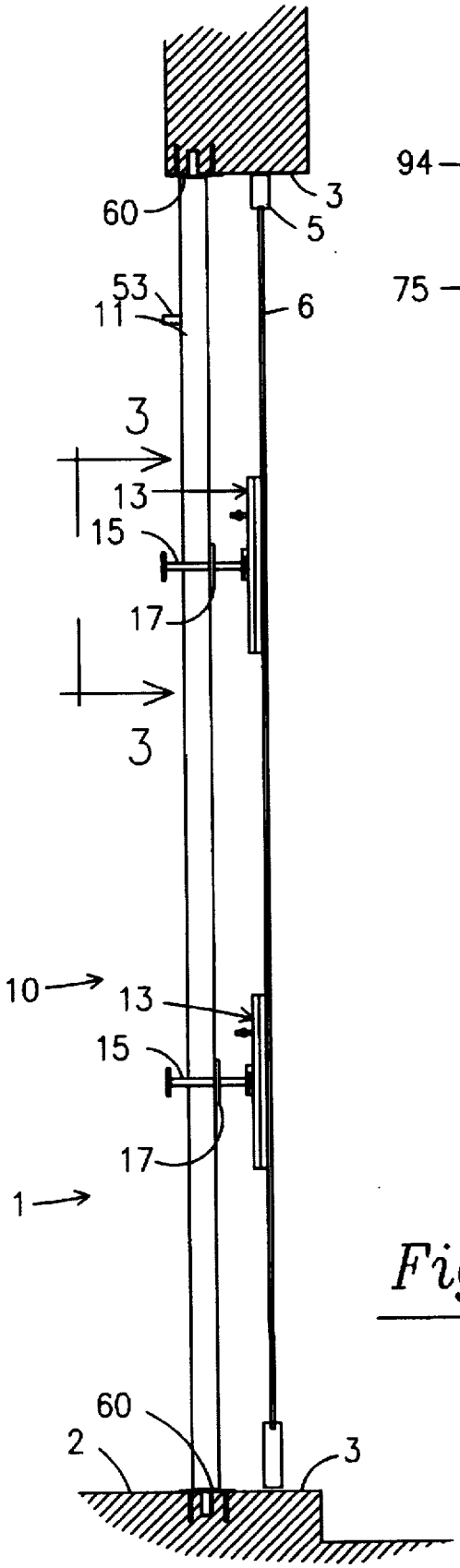
FIG. 2 shows a side view of the system illustrated in FIG. 1.

With reference, first, to FIGS. 1 and 2, a room 1 of a building has a floor 2 and a window frame 3 in which may be installed a fixed or movable window. In the example best seen with reference to FIGS. 1 and 2, the window 4 consists of frame 5 and window pane 6 as well as frame 7 and window pane 8, with one of the frames 5 or 7 being movable with respect to the other frame such that the frames 5 and 7 define a device well known in the art as a sliding glass door.

Figure 3:
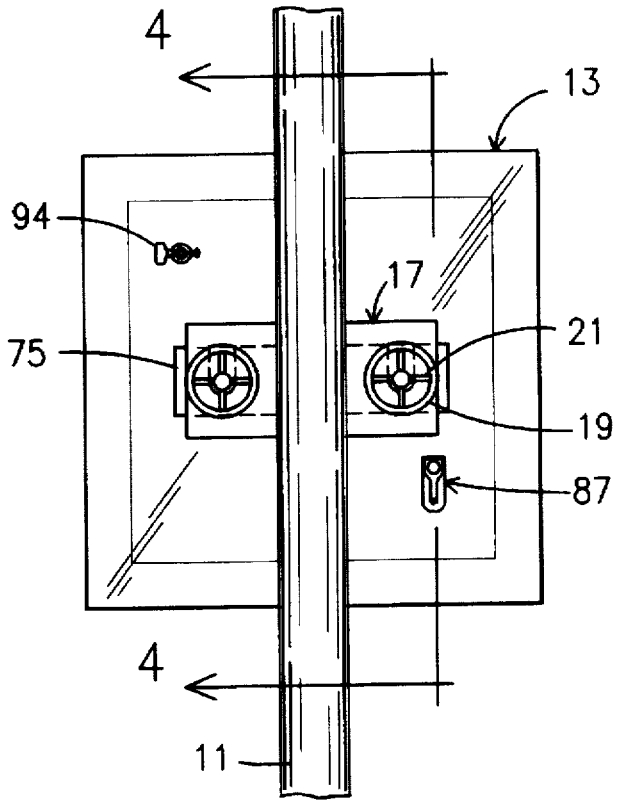
FIG. 3 shows an enlarged front elevational view of a portion of the structure illustrated in FIGS. 1 and 2.
Figure 4:
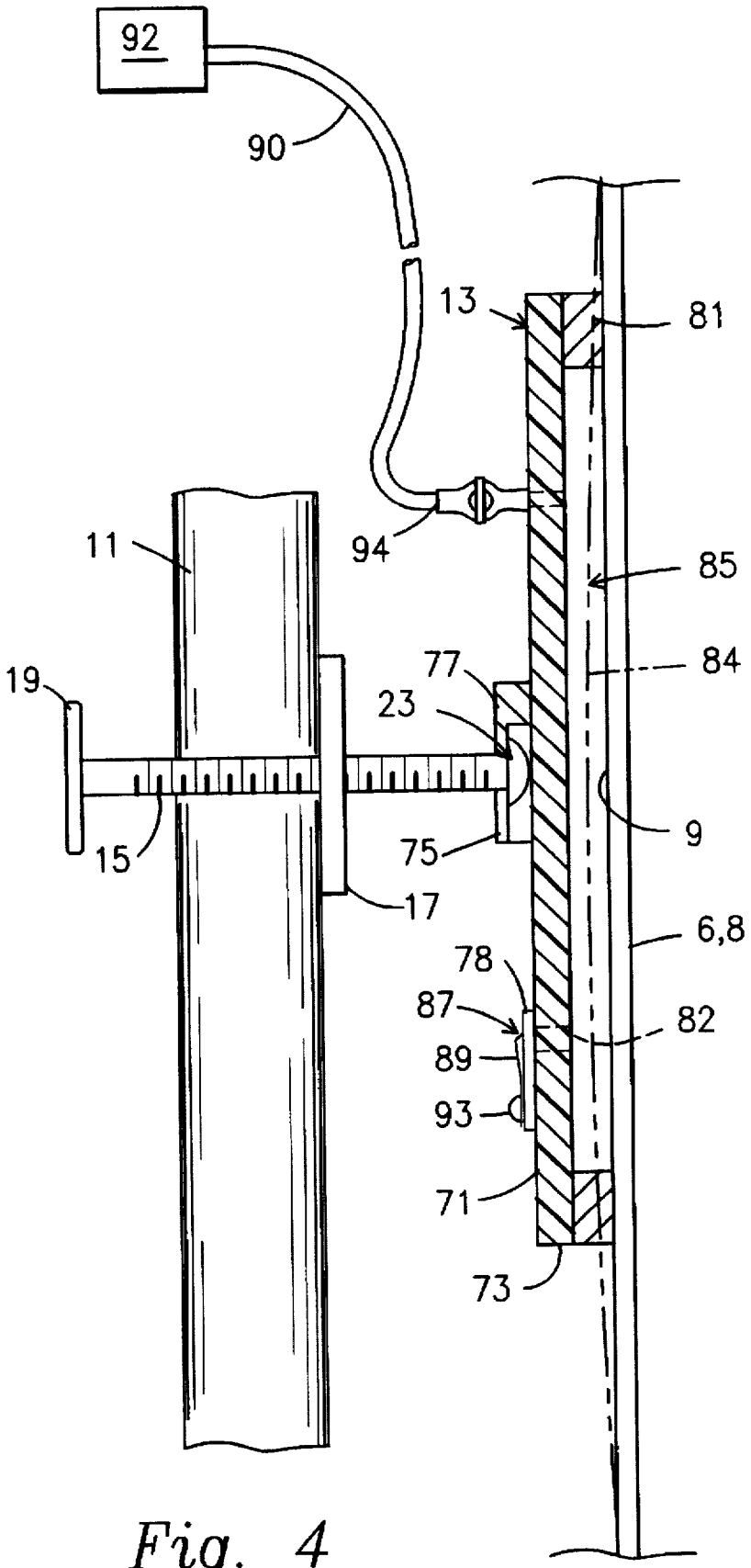
FIG. 4 shows a cross-sectional view along the line 4—4 of FIG. 3.

The present invention is generally designated by the reference numeral 10 and is seen to include one or more support posts 11, one or more pads 13, and each pad 13 having associated therewith clamping means comprising a threaded stem 15 and a block 17 engaged on a side of the post 11 facing the pad 13 as best seen with reference to FIG. 4. The stem 15 may have a handle 19, shown in the figures as a wheel having spokes 21 (FIG. 3, in particular).

The stem 15 has the handle 19 at a proximal end thereof and has a knob 23 at its distal end (FIG. 4) for a purpose to be described in greater detail hereinafter.

Figure 5:
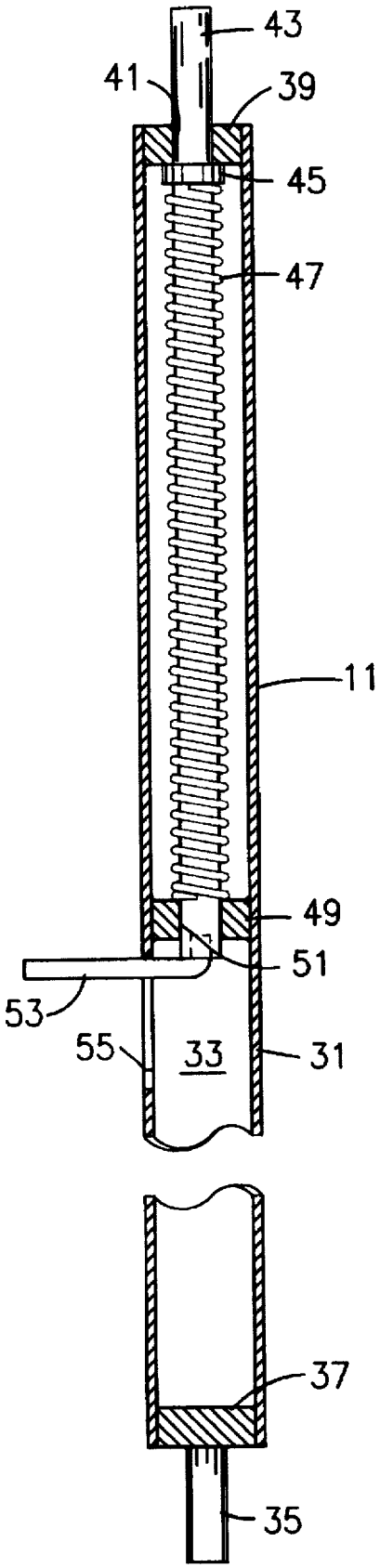
FIG. 5 shows a side view, partially in cross-section, of one of the support posts illustrated in FIG. 1, with parts broken away to show detail.

With reference to FIG. 5, the rectangular shaped post 11 includes an outer shell 31 defining an internal chamber 33 closed at its bottom end with a pin 35 fixed to the bottom of the shell 31 via a fitting 37 attached to the inner walls of the shell 31 by any suitable means such as welding, adhesive, etc. The rectangular post 11 can be further reinforced in accordance with well known methods.

At the opposite end of the shell 31, an upper fitting 39 is provided having a central opening 41 through which an upper pin 43 may reciprocate. The upper pin 43 has a disc 45 fixedly secured thereto to capture one end of a compression spring 47 having another end bearing against a further disc 49 fixedly secured to the inner walls of the shell 31 and having an opening 51 through which the pin 43 may reciprocate. In this way, the compression spring 47 biases the pin 43 in a direction of upward movement in the view of FIG. 5.

At the bottom of the pin 43, a perpendicular locking lever 53 is affixed thereto and extends through a slot 55 in the shell which has an L-shaped configuration including an elongated vertically extending portion 57 and a short horizontally extending portion 59 as best seen in FIG. 1. As should be understood, when the lever 53 is engaged within the portion 59 of the slot 55, the pin 43 is retracted and is constrained from vertical movement. When the lever 53 is slightly rotated so that it is aligned with the elongated portion 57 of the slot 55, the spring 47 reciprocates the pin 43 upwardly in the view of FIG. 5 to the position of extension shown in FIG. 5. The disc 45 limits the extent of vertical movement of the pin 43 to the position shown in FIG. 5.

Figure 6:
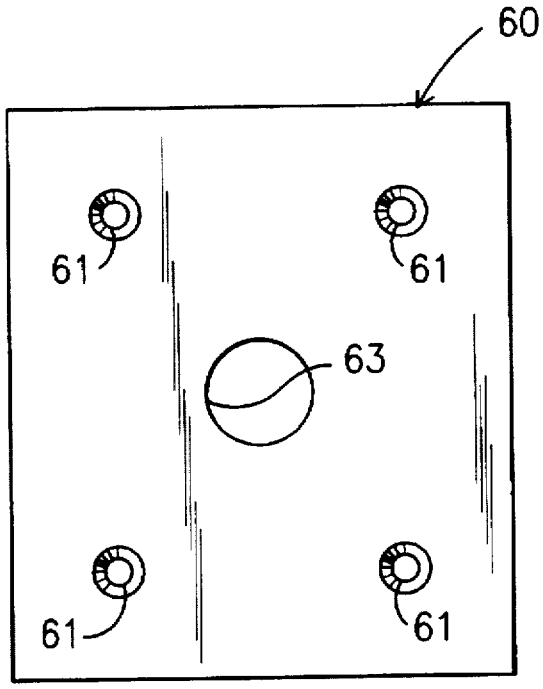
FIG. 6 shows a top view of a fixture used to support either end of the support post in the floor and ceiling, respectively, of a room.

With reference to FIG. 6, a fixture 60 is seen to have a generally rectangular configuration including holes 61 designed to receive threaded fasteners and a central opening 63 sized to receive either the pin 35 or the pin 43 therethrough. Referring back to FIG. 1, it is seen that fixtures 60 are provided, two for each post 11, and the pins 35, 43 are seen extending through the openings 63 in the fixtures 60. Additionally, threaded fasteners 65 are schematically shown and extend through the openings 61 in the fixture 60. As should now be understood, the post 11 may easily be erected by first retracting the pin 43, inserting the pin 35 within the opening 63 in the lower fixture 60, pivoting the post to a position of alignment of the pin 43 with the opening 63 in the upper fixture 60 and rotating the lever 53 to align it with the vertical portion 57 of the slot 55 so that the spring 47 reciprocates the pin 43 through the opening 63 to lock the post 11 in the vertical configuration best seen with reference to FIG. 1.

Figure 7:
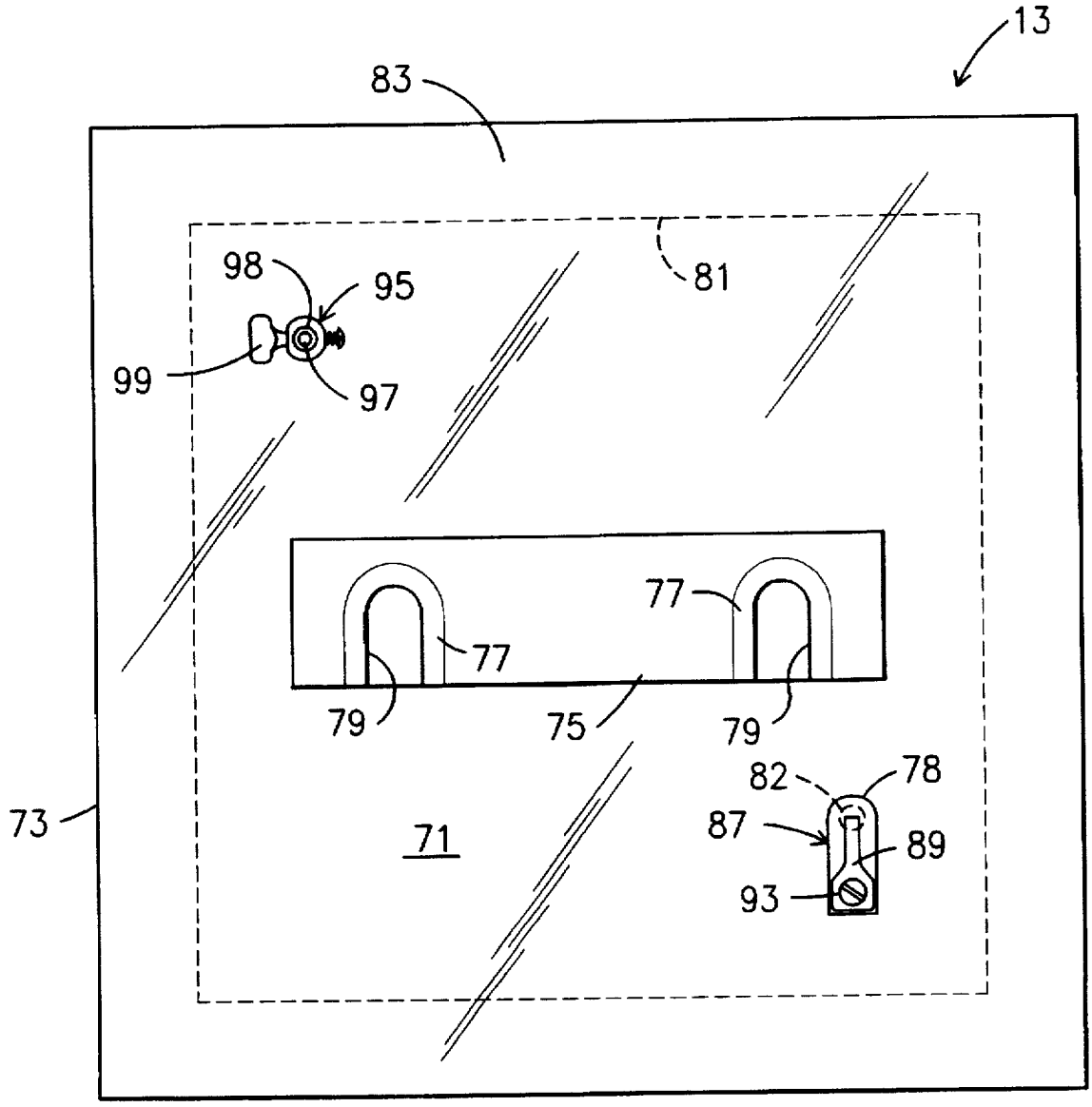
FIG. 7 shows a front view of a pad in accordance with the teachings of the present invention.

FIG. 7 shows a front view of the pad 13 looking from left to right in FIG. 4, that is seen to include a front wall 71 having a periphery 73 and having mounted thereon a plate 75 having two U-shaped members or fittings 77 mounted thereon, each one of which has a U-shaped slot 79 therein, each of which is designed to removably receive the knob 23 of a stem 15 as best seen with reference to FIG. 4. Also shown in FIG. 7 is the innermost extent 81 in phantom of the peripheral walls 83 of the pad 13 that, as best seen in FIG. 4, define with the front wall 71 an internal chamber 85 also defined by inner surfaces 9 of the window pane 6.

The present invention contemplates evacuation means incorporated into the pad 13. As seen in FIG. 7, a rear wall 71 has an opening 82 therethrough that allows access between the chamber 85 and the ambient atmosphere. A rubber sheet 78 is fastened in place overlying the opening 82 with a spring steel member 89 overlying the rubber sheet 78 and held in place by the pin or screw 93. The rubber sheet 78 comprises a check valve flap that allows escape of air from the chamber 85 but prevents reverse flow of air into the chamber 85.

Also seen in FIG. 7 is a valve 95 controlling flow of air from the chamber 85 via an opening 97 fluidly connecting the chamber 85 to atmosphere. The valve 95 includes a valve head 98 preferably of the rotary type such as, for example, cylindrical, conical or spherical, and having a port therethrough that may be aligned with the opening 97 to allow flow or may be misaligned therewith to prevent flow. A handle 99 may be gripped by the user to allow opening and closing of the valve 95. As best seen in FIG. 4, the valve 95 has a fitting 94 allowing the valve to be coupled to a suitable source of vacuum 92 via a hose 90. The valve 95 may be opened to fluidly connect the chamber 85 to the source of vacuum 90, whereupon the source of vacuum 90 may be activated to evacuate the chamber 85. The valve 95 may be closed to maintain the reduced pressure atmosphere within the chamber 85.

FIG. 4 shows a phantom line 84 illustrating the inward bowing of the window 6 in response to exposure to high winds. As should be understood from the phantom line 84, when the window 6 bows inwardly, the volume of the chamber 85 reduces in size. As explained above, such reduction in size causes air within the chamber 85 to be expelled through the check valve 87. When winds diminish and the bowing of the window 6 reduces, the chamber 85 increases in size, however, the check valve 87 prevents return of air into the chamber 85 so that a suction force is developed that tends to hold the window 6 to the pad 13 thereby strongly deterring flexing of the window 6.

With the present invention having been described in detail, the intended mode of use will now be explained. The posts 11 are installed in the manner shown in FIG. 1, as explained above, by first mounting fixtures 60 in the floor and ceiling of the room 1 adjacent the window pane or panes to be protected. The post 11 is erected in the manner described above by inserting the pin 35 within the lower fixture 60, retracting the pin 43, aligning the post 11 with the upper fixture 60 with the pin 43 aligned with the opening 63 thereof and release of the lever 53 allowing the spring 47 to reciprocate the pin 43 through the opening 63 in the upper fixture 60 to lock the post 11 in the position shown in FIG. 1.

Thereafter, a pad 13 is placed against a window pane in the manner shown in FIGS. 1, 2 and 4, the knob 23 of the stem 15 is engaged within the U-shaped coupling 77 with the block 17 threaded thereover. The stem 15 is reciprocated by gripping the handle 19 until the block 17 engages a side of the post 11 facing the window pane 6, whereupon further rotation of the stem 15 causes the pad 13 to tightly engage the window pane 6 creating the chamber 85 as defined by the rear wall 71 of the pad 13, the peripheral walls 83 thereof and the inner surface 9 of the window pane 6.

As best seen with reference to FIGS. 1 and 3, in the preferred embodiment of the present invention, the block 17 carries two stems 15 that are disposed to either side of the post 11 thereby balancing the forces to either side thereof since the block 17 utilizes the post 11 as a fixed member allowing pressure to be applied onto the pad 13 via the stems 15.

In one mode of operation, as wind speeds increase, the pane 6 bows inwardly as shown by the phantom line 84 in FIG. 4 thereby causing reduction in the size of the chamber 85 with air evacuating through the flap 78 of the check valve 87, which prevents reverse flow of air thereby creating a partial vacuum within the chamber 85. Alternatively, or supplementarily, the port 94 of the valve 95 is coupled to a source of vacuum, the valve 95 is opened allowing the source of vacuum to evacuate the chamber 85 and then the valve 95 is closed to seal the partial vacuum within the chamber 85.

In either mode, the partial vacuum created within the chamber 85 enhances adherence of the pad 13 to the pane 6 thereby reducing flexing of the pane 6 inwardly and outwardly.

Figure 8:
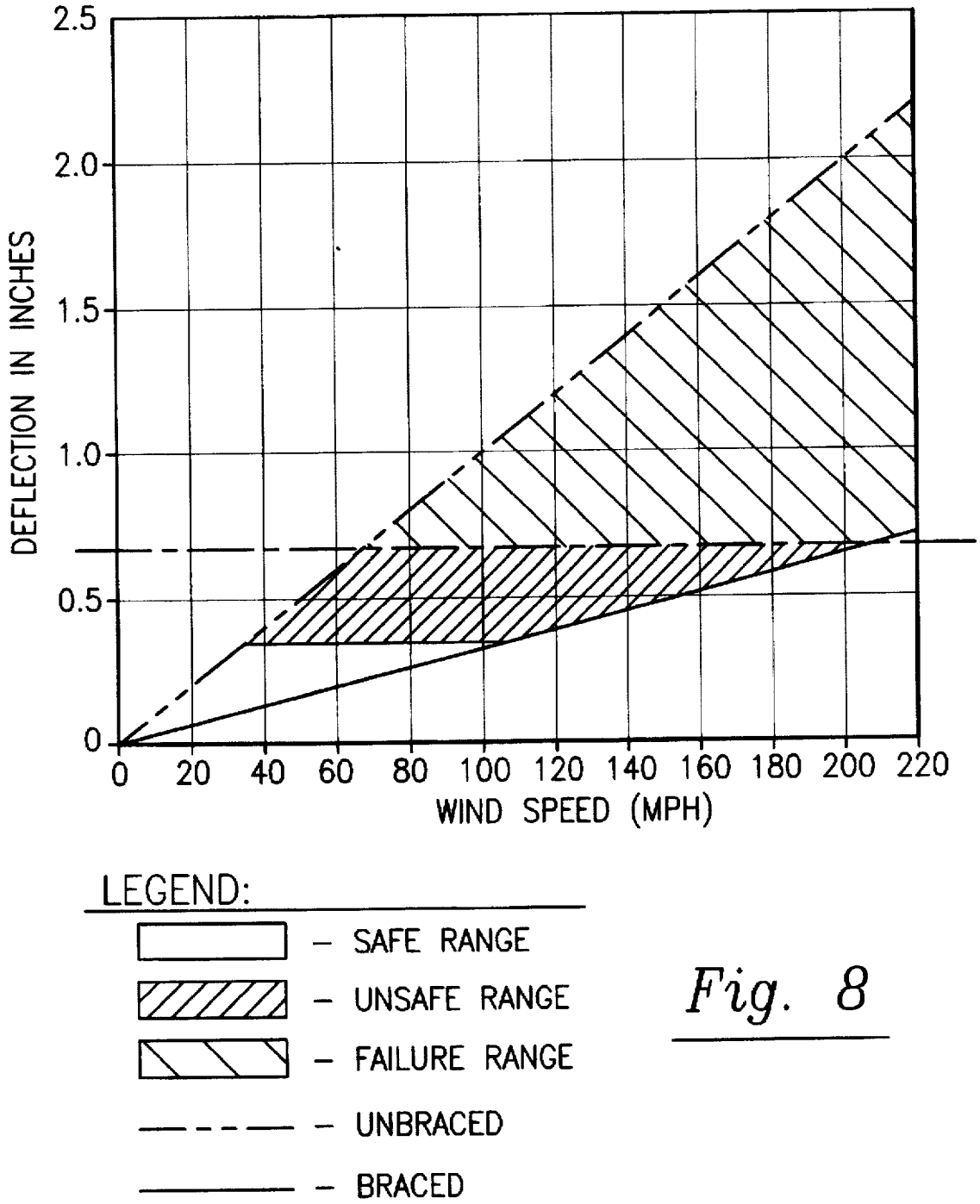
FIG. 8 shows a graph of deflection versus wind speed illustrating safe, unsafe and failure ranges for a window pane on a four foot by six foot, eight inch sliding glass door exposed to high winds.

FIG. 8 illustrates the increase in deflection of a window pane as wind speed increases. As seen in the graph, for wind speeds of up to about 115 miles per hour, if deflection of a four foot by six foot, eight inch sliding glass door window pane can be maintained not to exceed about 0.3 inches, the window pane is generally safe from breakage. As also seen in the graph, when deflection of the window pane exceeds about 0.7 inches, a window pane will commonly shatter.

In the preferred embodiment of the present invention, the post 11 is made of strong steel as are the fixtures 60. The pins 35, 43 are also made of steel.

In the preferred embodiment, the rear wall 71 of the pad 13 may be made of any suitable material such as plywood, plastic such as that which is sold under the Trademark LEXAN or metal, and the peripheral walls 83 thereof may be made of a suitable sealing material such as, for example, rubber or soft plastic such as foamed polyethylene having a thin, continuous outer skin.

The block 17 should be made of a strong material such as steel or aluminum. The pin 15 comprises a threaded steel rod.

Accordingly, an invention has been disclosed in terms of a preferred embodiment thereof which fulfills each and every one of the objects of the present invention as set forth hereinabove and provides a new and useful high wind window brace of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A high wind window brace, comprising:

a) a vertically disposed post adapted to be fixedly mounted adjacent a window pane;

b) a pad having a rear wall, and having peripheral walls engageable with a window pane, said rear wall and peripheral walls adapted to define, with a window pane, an enclosed chamber;

c) clamping means between said post and pad for clamping said pad peripheral walls into firm engagement with a window pane; and d) evacuation means for at least partially evacuating air within said chamber to cause a suction force to be applied enhancing adherence of said pad to a window pane.

2. The brace of claim 1, wherein said post has upper and lower pins receivable in respective holes of upper and lower fixtures mounted on a ceiling and floor, respectively.

3. The brace of claim 2, wherein said upper pin is retractable.

4. The brace of claim 3, wherein said upper pin is biased to a position of extension by a compression spring.

5. The brace of claim 1, wherein said pad is generally rectangular.

6. The brace of claim 1, further including a fitting mounted on said rear wall of said pad, said clamping means including a stem having a distal knob releasably coupled to said fitting.

7. The brace of claim 6, further wherein said stem is threaded, said stem having a block threadably received thereon and engaging a rear face of said post whereby rotation of said stem causes said block to engage said post and said pad to engage a window pane.

8. The brace of claim 7, further wherein two stems threadably receive said block and couple to said fitting, said stems being spaced to either lateral side of said post.

9. The brace of claim 1, wherein said peripheral walls of said pad are made of a resilient material.

10. The brace of claim 9, wherein the pad resilient material comprises rubber or soft plastic.

11. The brace of claim 1, wherein the pad evacuation means comprises an opening through said rear wall fluidly connecting said chamber to atmosphere, and a check valve mounted over said opening and allowing flow of air from said chamber but preventing flow of air into said chamber.

12. The brace of claim 1, wherein the pad evacuation means comprises a passageway through said rear wall fluidly connecting said chamber to atmosphere, and a valve in said passageway operable between open and closed positions, said valve having an inlet connected to said chamber and an outlet outside said chamber.

13. The brace of claim 12, wherein the outlet outside said chamber is connectable to a source of vacuum whereby, with said valve in said open position, said chamber may be evacuated whereupon said valve may be closed to maintain pressure below ambient pressure within said chamber.

14. The brace of claim 11, wherein the pad evacuation means further comprises a passageway through said rear wall fluidly connecting said chamber to atmosphere, a valve in said passageway operable between open and closed positions, said valve having an inlet connected to said chamber and an outlet outside said chamber.

15. The brace of claim 14, wherein said outlet outside said chamber is connectable to a source of vacuum whereby, with said valve in said open position, said chamber is evacuated whereupon said valve is closed to maintain pressure below ambient pressure within said chamber.

16. A high wind window brace, comprising:

a) a vertically disposed post adapted to be fixedly mounted adjacent a window pane, said post having upper and lower pins receivable in respective holes of upper and lower fixtures mounted on a ceiling and floor, respectively, said upper pin being retractable and being biased to a position of extension by a compression spring;

b) a generally rectangular pad having a rear wall and resilient peripheral walls engageable with a window pane, said rear wall and peripheral walls adapted to define, with a window pane, an enclosed chamber, said pad having a fitting mounted on said rear wall;

c) clamping means between said post and pad for clamping said pad peripheral walls into firm engagement with a window pane, said clamping means including two threaded stems to either side of said post, each having a distal knob coupled to said fitting, said stems having a block threadably received thereon and engaging a rear face of said post whereby rotation of said stems causes said block to engage said post and said pad to engage a window pane; and d) evacuation means for at least partially evacuating air within said chamber to cause a suction force to be applied enhancing adherence of said pad to a window pane.

17. The brace of claim 16, wherein said evacuation means comprises an opening through said rear wall of the pad fluidly connecting said chamber to atmosphere, and a check valve mounted over said opening and allowing flow of air from said chamber but preventing flow of air into said chamber.

18. The brace of claim 17, wherein said evacuation means further comprises a passageway through said rear wall of the pad fluidly connecting said chamber to atmosphere, a valve in said passageway operable between open and closed positions, said valve having an inlet connected to said chamber and an outlet outside said chamber.

19. The brace of claim 18, wherein said outlet is connectable to a source of vacuum whereby, with said valve in said open position, said chamber may be evacuated whereupon said valve may be closed to maintain pressure below ambient pressure within said chamber.

20. A method of protecting a window from shattering in a high wind condition comprising (a) fixedly mounting a vertical post adjacent the window, (b) mounting at least one pad between the post and the window with a threaded stem connecting the post to the pad, the pad having four peripheral soft walls and a back wall opposite the window, (c) rotating the stem to cause the pad to engage the window to tightly engage the window to form a sealed chamber within a space enclosed by the window, the back wall and peripheral walls of the pad and (d) evacuating the chamber to form at least a partial vacuum in the chamber.

* * * * *